US005456386A

United States Patent [19]

Jesswein

[11] Patent Number: 5,456,386

[45] Date of Patent: Oct. 10, 1995

[54] TWO-COMPONENT PRESSURE CONTAINER FOR PRODUCING FOAM

[75] Inventor: Bruno Jesswein, Bad Kreuznach, Germany

[73] Assignee: Bruno Jesswein Kunststofftechnik Inh. Werner Morck, Bad Kreuznach, Germany

[21] Appl. No.: 245,498

[22] Filed: May 18, 1994

[30] Foreign Application Priority Data

May 18, 1993 [EP] European Pat. Off. ..... 93108063

[51] Int. Cl.[6] ..... B65D 83/14

[52] U.S. Cl. ..... 222/136; 222/402.21

[58] Field of Search ..... 222/129, 135, 222/136, 145, 402.21, 402.22

[56] References Cited

U.S. PATENT DOCUMENTS

| | | | |
|---|---|---|---|
| 3,255,926 | 6/1966 | Modderno | 141/21 X |
| 3,318,484 | 5/1967 | Modderno | 222/136 |
| 3,372,839 | 3/1968 | Hayes | 222/136 X |
| 3,420,033 | 1/1969 | Modderno . | |
| 4,613,061 | 9/1986 | Meuresch et al. | 222/541 X |
| 5,167,347 | 12/1992 | Wiegner et al. | 222/136 X |

FOREIGN PATENT DOCUMENTS

| | | |
|---|---|---|
| 0062609A1 | 3/1982 | European Pat. Off. . |
| 0528190A1 | 7/1992 | European Pat. Off. . |

*Primary Examiner*—Kevin P. Shaver
*Attorney, Agent, or Firm*—Fisher & Associates

[57] ABSTRACT

A two-component pressure container is provided. The pressure container comprises a valve, an outer container for a first component and a foaming agent as well as an inner container sealed against the outer container for the second component and eventually another foaming agent, in which the outer container is provided with a tube extending towards the bottom of the box. The inner container is affixed in a detachable manner and hermetically sealed against the outer container by sealing elements, and in which, by actuating the valve from the outside, the inner container can be opened into the outer container. Such a two-component pressure container is particularly suitable to produce two components foams, e.g., polyurethane foams.

9 Claims, 2 Drawing Sheets

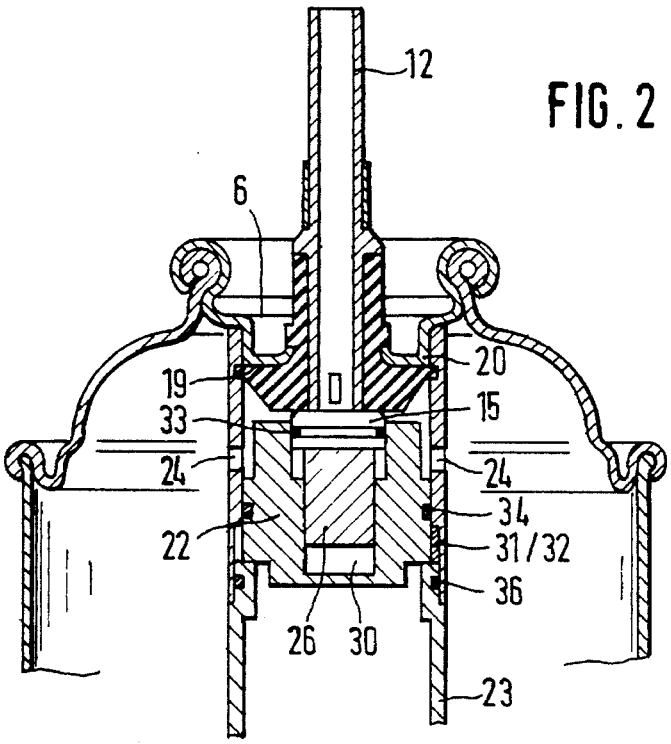
FIG. 2
FIG. 3
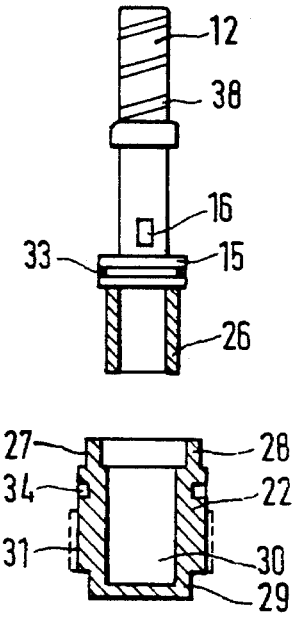
FIG. 4
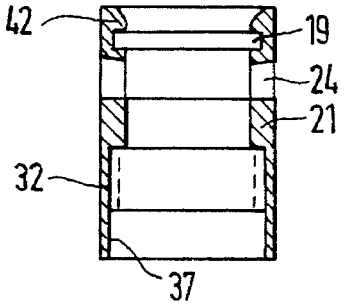
FIG. 5
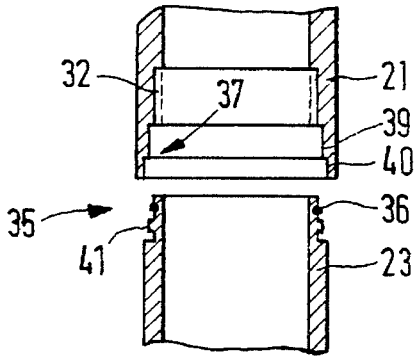

TWO-COMPONENT PRESSURE CONTAINER FOR PRODUCING FOAM

BACKGROUND OF THE INVENTION

1. Field of the Invention

The invention relates to a two-component pressure container box with a valve, an outer container for a first component and a foaming agent as well as an inner container sealed against the outer container for the second component and eventually another foaming agent, in which the outer container is provided with a tube extending towards the bottom of the box, and the inner container is affixed in a detachable manner and hermetically sealed against the outer container by means of sealing elements, and in which, by actuating the valve from the outside, the inner container can be opened into the outer container. Such a two-component pressure container is particularly suitable to produce two-components foams, e.g., polyurethane foams.

2. Description of the Prior Art

In particular, to produce two-component plastic foams, many techniques were developed to house separated from each other the reactive components that are necessary for the foam formation. For this, into an outer pressure container containing the prepolymer is usually inserted a second, inner pressure container with the second component, the content of which is emptied into the prepolymer by releasing it from the outside, thus mixing it with the prepolymer. The therein originated reactive mixture is then ejected by a foaming agent in the pressure container under foam formation. In known two-component pressure containers the inner container for the second component is located, e.g., in the area immediately above the box bottom. The release mechanism, by means of which is achieved the combining of the two components, is affixed at the bottom of the box and is actuated either by pressing or by twisting. By way of example, reference is made in this respect to the German registered utility patent 82 27 228 as well as to DE-A-30 22 389 and DE-A-33 22 811.

The disadvantage of these known solutions with a release mechanism in the bottom area is that, apart from the costly valve construction in the dome area of the pressure container, a second, costly molded area is necessary at the bottom of the container. On the one hand, this increases the manufacturing requirements and thus the manufacturing costs and, on the other hand, it creates a second area at the pressure container that is susceptible to influences from the outside, which must be protected against forced influences from outside by means of suitable measures, such as, e.g., the placing of gaskets, protecting caps or safety devices. Furthermore, the valve for the filling of the pressure container with a foaming agent cannot be easily arranged—as it is customary in some instances—in the middle of the chamber container.

It is further known, to arrange the inner container of a two-component pressure container directly below the valve assembly in the upper area of the pressure container. Pursuant to U.S. Pat. No. 3,635,261, an inner container arranged in such a manner below the valve assembly is placed under such a high pressure by means of a propellant-filled cartridge, affixed from the outside, that it bursts, that the content of the inner container discharges into the outer container, thus obtaining the desired mixing of the two components. Subsequently, the mixture is released in the usual manner by means of the valve.

Pursuant to U.S. Pat. No. 3,318,484 an inner container arranged in such a manner below the valve assembly is opened and discharges into the outer container because, through a downward movement of the valve, a rod arranged inside the inner container extending to its bottom acts upon the bottom in such manner that it loosens the gasket between the inner container and the mounting in the dome of the pressure container. A disadvantage in this connection is, however, that the content of the inner container can also be activated by an unintentional pressure or impact effect, resulting in a premature mixing of the components in the container. Furthermore, an actuation of the valve prior to the mixing of the two components cannot be excluded, which would result in a premature discharge of the inner container, thus rendering unusable the entire content of the pressure container because the amounts of the two components are not formulated for each other.

All in all, the hitherto known pressure containers with an inner container arranged in the upper area have proven to be somewhat unreliable, so that such pressure containers did not find acceptance on the market. On the other hand, however, the arrangement of the inner container on the inside of the valve unit is desirable in order to concentrate at one place the technically important elements of such a pressure container, which has manufacturing engineering advantages, and to keep low the number of the movable elements of such a pressure container which, in turn, has application and safety engineering advantages.

From EP-A-0 528 190 is known a two-component pressure container with an outer container for a first component and foaming agent and an inner container sealed against the outer container for the second component and, eventually, another foaming agent, in which by means of the valve the inner container can be opened to the outer container, by rotating the valve tube towards the valve seat. This can be obtained by an arrangement in which the outer container is provided at the valve disk with a tube extending to the bottom of the box, in which in the tube is placed a gear mechanism that is connected to the valve tube by an extension piece through the valve body, which under a rotary movement of the valve pipe actuates upon a journal in direction to the bottom of the pipe, and being the inner container detachably mounted at the bottom of the tube and hermetically sealed against the inside of the tube by means of a sealing element. A rotary movement of the valve tube causes a downward movement of the journal that, acting upon the inner container, irreversibly disengages it from the tube.

These two-component pressure containers have proven themselves in practical operation but, because of the journal's free movability in the tube, they require special care when filling them with propellant, when this filling shall be effected through the valve assembly. It turned out, however, that because of the suddenly occurring pressure surge during filling, the journal can be driven toward the inner container, which can lead to its premature opening into the outer container. Furthermore, the sudden pressure surge can lead to that the tube arranged at the valve disk is disengaged from its seat, dropping together with the inner container into the outer container. Although in such a case the inner container does not open into the outer container, the pressure container is ruined for the intended use.

Thus, the purpose of the invention is making available a two-component pressure container in which a second container is arranged below the valve unit, that is of easy manufacture, of safe storage and protected against an unintentional disengaging, and that makes possible a reliable disengaging with a subsequent complete mixing of both components as well as an easy filling of both the inner and the outer containers. In particular, the inner container shall be protected against an undesirable displacement when filling the pressure container with propellant through the valve.

This task is solved by means of a pressure container of the initially described type, in which the valve tube presents a contact element at its section extending through the valve body into the outer container; this contact element locks into a complimentarily formed recess in a screw assembly that meshes with an outside thread into a female thread of the tube arranged above the inner container, so that a rotary motion of the valve tube is imparted to the screw assembly by means of the contact element, separating the inner container through the thus resulting downward movement of the screw assembly. By means of the solution according to the invention, a rotary motion imparted by means of the valve stem to the valve and the therewith connected contact element is transmitted to the screw assembly and continues as forward thrust upon the inner container arranged at the end of the tube. As a result thereof, the inner container is separated from the end of the tube, so that the content, eventually under the pressure of a propellant gas, discharges into the content of the outer container, thus mixing with by an eventual shaking. A prerequisite for the separation process is, however, the rotary motion at the valve tube; thanks to the toothing of the gears a mere pressure exertion is not converted into a forward thrust.

Conventional tin containers or aluminum-drawn boxes can be considered as pressure containers.

By way of example, the tube is affixed to a concentric projection of the valve dish extending into the inside container. In particular, in the case of the tube it deals with a plastic tube that is tightly slipped over this concentric projection of the valve dish, thus extending vertically downward from the valve into the pressure container. At its valve-facing end it presents discharge openings in its wall, that render possible the passing through of the foam mass when emptying the pressure container or of the filling compound when filling the pressure container, respectively.

Of particular preference is an embodiment in which the tube presents at its valve-facing end an inside continuous groove into which engages a concentric projection of either the valve dish or, in particular, of the valve body. Instead of an inside continuous groove there can also be provided a continuous projection, extending inward in a step-like manner, or a protrusion of such type as to engage behind a continuous projection of the valve body or of the valve dish, or a combination of groove and projection.

As mentioned above, the rotary motion of the valve toward the valve seat to open the inner container is converted by a screw assembly into a downward directed movement. This is obtained by a combined action of the contact element at the bottom of the valve tube with the recess in the screw assembly. The contact element at the valve tube consists advantageously of a many-sided end piece, for example, a hexagon. However, any other embodiments of the contact element can also be used, on condition that they are provided with the toothing required for the rotary motion.

The contact element is preferably lodged or guided sliding vertically in the recess, so that by a pressing down on the valve tube it is possible to fill the container without having to separate the tube assembly with the inner container. For this purpose, a clearance is necessary between the bottom end of the contact element and the bottom of the recess, into which the contact element can slide by pressing down on the valve tube. Furthermore, the contact element and the recess are formed sufficiently long, in order to ensure a combined action up to the complete separation of the inner container with the downward-screwed screw assembly.

The valve tube, the contact element and the screw assembly, as well as the tube and the inner container, are made out of the customary suitable materials such as, e.g., a plastic, for instance polyethylene or polypropylene.

As stated above, the inner container is located at the side of the tube not facing the valve. Preferably, the upper, open end of the inner container is frictionally inserted into the tube, for which a gasket is provided between the outer wall of the inner container and the inside wall of the tube. In connection with another gasket, that is preferably formed between the screw assembly and the tube, there is obtained an effective separation of the content of the inner container from the outer container. This separation ceases to exist through the above described downward movement of the screw assembly by a rotary motion of the valve tube, inasmuch as the screw assembly pushes against the inner container pressing it out of its seating at the bottom of the tube. Thus, the content of the inner container is released and—with an adequate overpressure existing in the inner container compared to the outer container—it is also immediately ejected. The two-component pressure container is ready after the release and an eventually further shaking.

The gaskets between the inner container and the tube or between the screw assembly and the tube, respectively, are preferably formed as O-rings, that are seated in correspondingly shaped annular grooves.

The contact element is preferably arranged immediately below the disc that supports the valve tube against the bottom side of the valve body. It is advantageous for this disc to mesh into a round extension of the recess of the screw assembly, without however extending to its bottom end, so that by pressing down on the valve tube it can be pushed in farther. An annular gasket in a groove in the dish prevents the infiltration into the intake of the filling compound.

It is advantageous that the pressure container according to the invention is provided with a handling mechanism at the valve tube for a boosting of the rotary motion. This handling mechanism is screwed on to the valve tube whereby attention must be paid that the pitches of the screw thread at the valve tube and at the screw assembly or at the tube, respectively, run in such a manner as to avoid a loosening of the handling mechanism during the release. By way of example, such a handling mechanism consists of an extension of the valve tube that can be offset in the upper area, and presenting vertically projecting cross struts, that serve for the boosting of the rotary motion and, as a whole, result in a cruciform shape of the extension and the struts.

The pressure container according to the invention is also provided with a valve that can be used in both directions, which facilitates the filling of the pressure container. Thus, it is possible to fill at first the outer container with the prepolymer, e.g., a two-component foam, then to put in place the valve case with the connected and filled inner container, and finally to fill the already closed container through the valve tube and the corresponding openings in the tube with the propellant gas required for the discharge of the filling. In such a manner, the entire content of the outer container can be loaded.

DESCRIPTION OF THE DRAWINGS

The accompanying drawings illustrate the preferred embodiments of the invention, in which

FIG. 2 is a longitudinal cross-sectional view of a valve assembly with thereto affixed tube and inner container;

FIG. 3 shows a contact element and screw assembly for the separation of the inner container;

FIG. 4 is a sectional view of a tube, and

FIG. 5 shows the attachment of the tube and the inner container.

DETAILED DESCRIPTION OF THE PREFERRED EMBODIMENT

Figure 1:
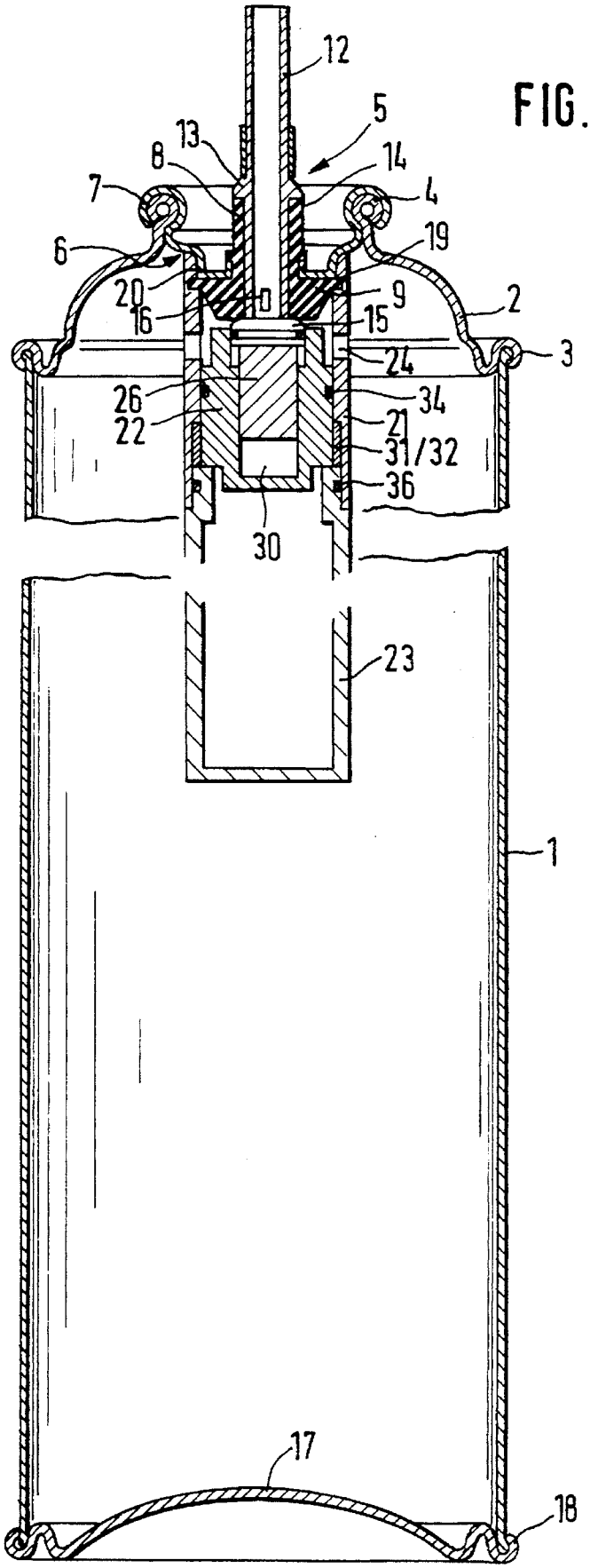
FIG. 1 is a longitudinal cross-sectional view of a pressure container according to the invention with inserted valve assembly and the inner container.

The pressure container shown in the drawings consists of a body 1 that is closed at one extremity with a dome 2. The dome 2 shows a tanged rim 3 that fastens the dome 2 to the referenced extremity of the body 1, concomitantly bringing about a tight connection of the components. The pressure container dome is made out of a round blank, that is to say, a round plate, a shaped part cut out of tin plate, which by deformation was given the dome-shaped form shown in the drawing. As shown in FIG. 1, the inside rim of the blank is tanged and holds the valve 5. On its part, the rim 7 of the valve disk 6 is tanged around rim 4 of the blank and it is thus sealed against it. In the center of the valve disk is a rubber plug 8 that, on its part, is held by a flange-like widening 9 to the underside 10 of the valve disk 6, and through which passes a hollow valve tube 12. This valve tube has an outer flange 13 that rests on the outer rim 14 of the plug. A disk 15 closes the valve tube 12 at its lower extremity. By tilting of or pressing on the valve, one or more openings 16 become accessible for the content of the container and serve for conveying the content of the container. The bottom of the pressure container is formed by a curved plate 17 that is tanged with its rim 18 around the corresponding extremity of the body 1.

The disk 6 of the valve assembly 5 is downward depressed in its central area and forms an edge 20 that runs concentrically around the rubber plug 8 and protrudes into the inside of the container; it can also radially project into the inside of the container. The projection or edge 20 serves as seat for a thereto connected tube 21, that is provided with an inner container 23 at its lower extremity. The inner container can be manufactured in one piece or—to facilitate the filling—it can be provided with a separate bottom.

FIG. 2 shows a cross-sectional view through the top end of a pressure container according to the invention as shown in FIG. 1. Underneath the valve assembly is the tube 21, that is slipped onto the edge 20 of the disk 6 and clamped in place to it. The seat of the tube 21 at the projection 20 is always so firm that it is impossible for the release mechanism to separate the inner container. In accordance with a special embodiment this can also be achieved, in that the edge 20 is widened to form a projection that is gripped by a projection at the upper extremity of the tube 21. Additionally or alternatively, the tube 21 can be secured to a projection or flange 19 of the valve body 6 by means of a groove provided on its inside.

Underneath the valve in the upper half of the tube 21 are provided openings 24, through which the outer container of the pressure container can be filled, and through which can be discharged the foam agents.

A disk 15, that becomes a contact element 26, is arranged underneath the valve body 9 as a direct extension of the valve tube 12 and is tightly connected to it. The contact element is of polygonal shape, in the present case a hexagon 26.

The contact element 26 acts in conjunction with a complementary thereto formed screw assembly 22, both of which constitute the separation mechanism for the inner container 23. For this purpose, the contact element 26 underneath the disk 15 is of hexagonal shape and engages into an also hexagonally shaped recess 30 of the screw assembly 22. Through the contact element 26, a rotary motion of the valve tube 12 is thus imparted to the screw assembly 22 which, in its mounting, is screwed downward in direction of the inner container 23.

In order to seal the hexagonally shaped recess 30 against infiltrating filling material, in the upper region is provided a circular widening 28 (see FIG. 3) into which can engage the disk 15 of the valve tube, and render effective a sealing element 33, preferably an O-ring, arranged along its periphery. Concomitantly, the circular widening 28 of the hexagonal recess 30 of the screw assembly 22, that extends into the screw assembly 22 by more than the thickness of the disk 15, allows a vertical play of the valve tube 12. A prerequisite for this is, however, that the contact element 26 does not fill the recess 30 as far as its bottom but that it also leaves a clearance. In this manner, the container can be filled through the valve tube by pressing down on the valve tube 12.

Furthermore, in the outer wall of the screw assembly 22 is provided a recess 27, that leaves a clearance in the area of this recess 27 between the wall of the tube 21 and the inserted screw assembly 22. Inside this clearance are provided the openings 24, that allow the passage of the filling material into the inside of the container when filling is effected through the valve tube 12, and the discharge of the foam from the inside of the container into the valve pipe 12.

The screw assembly 22 is screwed into a box thread 32 of the tube 21 by means of an external thread 31 that extends beyond the thickness of the screw assembly, and is held in this position by this thread. Through a rotary motion of the valve tube 12 and the transmission of this rotary motion by the contact element 26, this screw connection can be loosened and the screw assembly 22 can be screwed downward out of its mounting.

Directly underneath the screw assembly 22, the inner container 23 is frictionally slipped within the tube 21. The seat of the inner container 23 can be improved by a suitable shaping of the container rim and/or of the tube 21. The sealing of the inner container 23 against the outer container 21 is obtained by annular gasket-sealing washers 36 above the screw threads 31/32 between the inside wall of the tube 23 and the outside wall of the inner container 23, as well as between the screw assembly 22 and the tube 21.

FIG. 3 shows the individual components of the separating mechanism from FIG. 2. Therein, the contact element 26 is connected directly underneath the valve plate 15 to the valve tube 12 and firmly connected to it. The valve plate 15 is provided with a circular groove into which is inserted a gasket 33. Underneath the plate 15 is arranged the contact element 26, herein shown in its longitudinal cross-section, shaped as an hexagonal that is hollow on its inside. It must be understood, that the hollow section of the contact element 26 does not extend into the valve tube.

The screw assembly 22 is illustrated underneath the contact element 26 and presents the centered recess 30, also of hexagonal shape and as complement to the contact element 26. Above the recess 30 is provided a circular widening 28, into which the valve plate 15 with its continuous annular gasket is partially inserted in such a manner that a clearance is provided for a downward movement to the end of the widening 28. The length of the contact element 26 is coordinated with the depth of the recess 30 in such a manner that there is provided a vertical clearance that allows a pressing-in of the valve tube for the filling of the pressure pump.

The screw assembly 22 presents in its outer region an upper recess 27, that leaves free a continuous groove in the upper region of the screw assembly 22 inserted into the tube assembly 21. In the area of this groove are the openings 24 in the tube 21, through which can pass the propellants or the foaming agents, respectively.

In the lower region of the outer wall of the screw assembly 22 is located the screw thread 31, that meshes into a correspondingly shaped inside thread of the tube 21. The placing of the outside thread 31, projecting opposite to the wall, in connection with the inside thread 32, recoiling into the wall of the tube 21, allows the vertical displacement of the assembly 22 inside the tube 21. As sealant against the upper valve area, above the outside thread is provided a continuous groove for a gasket, preferably an O-ring, herein designated as 34. A recess 29 in the lower area of the outer wall of the assembly 22 does also constitute a continuous groove when the element 22 is screwed in, into which can mesh the rim of the inserted inner container 23 (see FIG. 2).

In respect to the valve tube 12, mention must be made of thread 38, by means of which can be screwed on a handling mechanism for the rotating and the actuating of the release mechanism.

FIG. 4 shows the longitudinal cross-section of a tube 21. In the upper region of the assembly are located the openings 24 for the filling compound—herein are shown only two but more than two can be provided around the periphery of the tube 21. Above the openings is provided a recess or groove 19, into which can mesh a correspondingly shaped projection 9 of the valve body 9. Through this provided a flexible connection between the valve body 9 and the tube 21, which is suitable to partly absorb any movement of the valve body. Furthermore, this connection supplements the support obtained by the tube 21 by mounting it over the inside rim 20 of the valve disk 6. In order to facilitate the mounting, the tube wall tapers at its upper extremity from the inside toward the outside, forming thus a bead 42 above the groove 19.

On the inside of the tube 21 is arranged the continuous inside thread 32, that acts in conjunction with the outside thread 31 of the screw assembly 22. Beneath the inside thread 32, the inside wall of the tube 21 forms a recess 37 against which rests the inner container 23 with a corresponding recess in the upper outer wall of the container and a continuous groove in the annular gasket 36.

FIG. 5 shows a longitudinal cross-section through the bottom of the tube 21 and the top of the inner container 23, for an illustration of one type of the fastening. In tube 21 is shown the thread 32 of the journal into which the screw assembly 22 is screwed in from below. In the bottom region of the tube is provided the recess 37, designed as two concentrically steps 39 and 40 inside the tube 21.

In addition thereto, the recess 35, running along the outer wall of the inner container 23, directly underneath the rim presents a groove with in O-ring 36, as well as projection 41 at a slight distance from this groove. With an adequate seating, the gasket 36 and the projection 41 act in conjunction with the step 39 of the tube 21, while the part of the wall of container 23, without the recess, slides into the area of the step 40 of the tube 21.

I claim:

1. A two-component pressure container, in particular for two-component foams, consisting of:

a valve comprising a valve body, a rotatable valve tube disposed therethrough, a valve disk disposed about said valve tube which mounts the valve to the two component pressure container and a disk at inner end of the valve tube;

an outer container for housing a first component and a first foaming agent, said outer container partially enclosing said valve; and an inner container, hermetically sealed in a detachable manner by a tube to said outer container, said inner container for housing a second component and a second foaming agent;

wherein said tube extends into said outer container and toward a bottom thereof, a bottom of said tube is affixed in a detachable manner to said inner container, said disk having a contact element, that meshes in a complementary shaped recess of a screw assembly disposed in said tube and engageable with said inner container, and that said screw assembly engages with an outside thread into an inside thread of said tube so that a rotary motion of said valve tube is transmitted by said contact clement to said screw assembly and thereby generating a downward movement of said screw assembly which moves the inner container such that it separates said inner container from the tube thereby allowing said first and second components to mix in said outer container.

2. A pressure container according to claim 1 wherein said tube rests in a concentric flange of said valve disk, and a recess of the tube running parallel to an inside edge of said tube engages into said flange of said valve disk.

3. A pressure container according to claim 1 wherein said tube includes an inside groove for engaging a concentric flange of said valve body.

4. A pressure container according to claim 1 wherein said tube includes openings in walls of said tube adjacent the valve body.

5. A pressure container according to claim 1 wherein said contact element is vertically displaceable in said recess.

6. A pressure container according to claim 1 wherein said contact element has a polygonal shaped portion which engages into said recess in said screw assembly.

7. A pressure container according to claim 6 wherein said disk element engages into a round widening of said screw assembly and that said disk is provided with an outside gasket that presses against said wound widening of said screw element.

8. A pressure container according to claim 1 wherein said screw assembly is provided with a gasket in a wall region above said outside thread that presses against an inside wall of said tube.

9. A pressure container according to claim 8 wherein a gasket is provided between an inside wall of said tube and an outside wall of said inner container.

* * * * *